United States Patent [19]

Hayes

[11] 4,354,280

[45] Oct. 19, 1982

[54] JOINT PROTECTOR

[75] Inventor: John B. Hayes, Walhalla, S.C.

[73] Assignee: The Kendall Company, Walpole, Mass.

[21] Appl. No.: 220,526

[22] Filed: Dec. 29, 1980

[51] Int. Cl.[3] ..... A41D 13/08

[52] U.S. Cl. ..... 2/16; 2/24

[58] Field of Search ..... 2/16, 2, 18, 20, 22, 2/24, 158, 161 R, 161 A, 163, 168, 97

[56] References Cited

U.S. PATENT DOCUMENTS

| | | | |
|---|---|---|---|
| 2,036,413 | 4/1936 | Herbruk | 2/168 |
| 2,291,184 | 7/1942 | Cartier | 2/18 |
| 3,116,489 | 1/1964 | Weiss | 2/97 |
| 4,272,850 | 6/1981 | Rule | 2/24 |

FOREIGN PATENT DOCUMENTS

| | | | |
|---|---|---|---|
| 1562191 | 3/1980 | United Kingdom | 2/22 |

*Primary Examiner*—Richard J. Scanlan, Jr.

[57] ABSTRACT

A contact sport joint protector for protecting the knee or elbow limb joint comprising a unitary, relatively thick, foam-filled, semi-rigid, resilient, molded plastic pad of generally rectangular compound-curved configuration to conform with the shape of said limb joint. The concave inner surface and the opposed side edges of the pad have opposed hinge grooves extending inwardly from each of the opposed side edges to define a hinge portion adapted to overlie the limb joint to enable bending of the normally straight pad upon bending of the limb joint and return of the pad to its normally straight configuration upon straightening of the limb joint. A backing layer of soft, foam plastic material may be adhered to the inner surface of the plastic pad.

5 Claims, 6 Drawing Figures

FIG 5
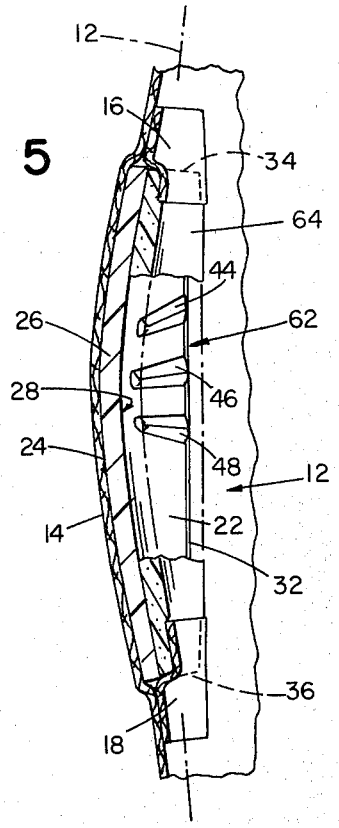
FIG 6
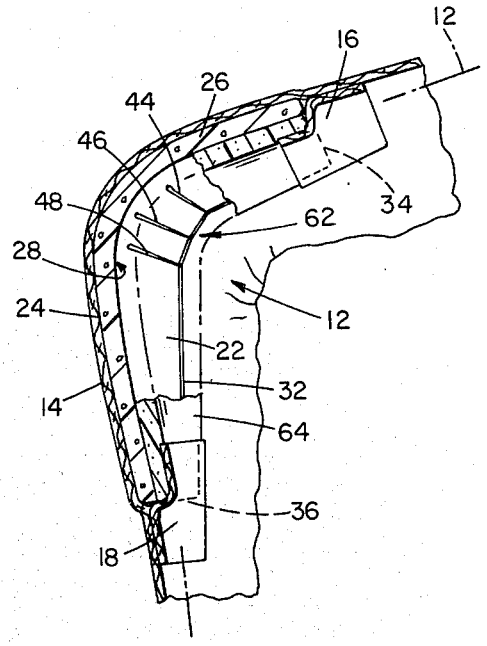
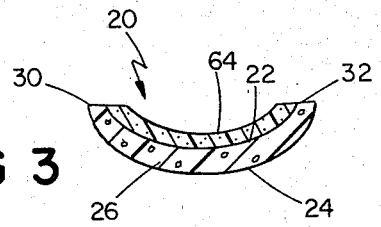
FIG 3
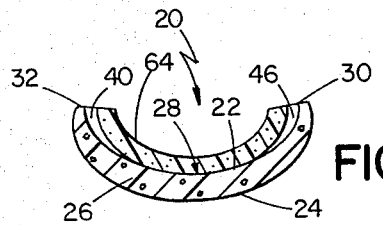
FIG 4
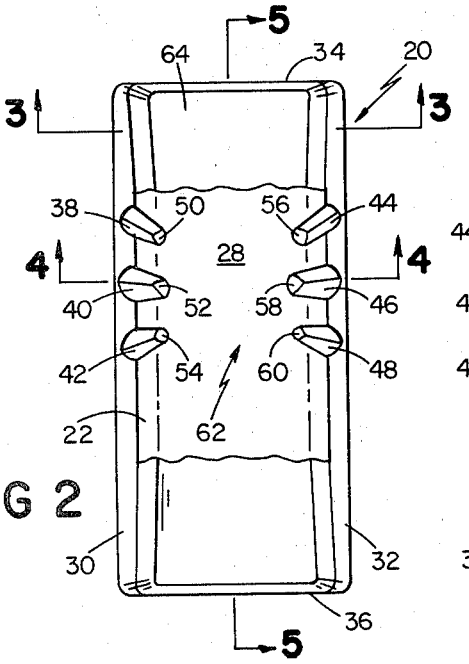
FIG 2
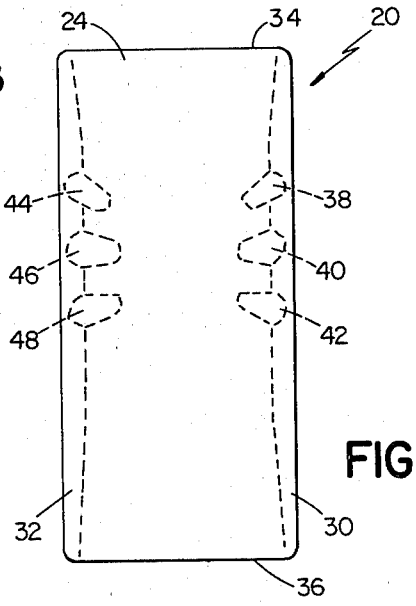
FIG 1

JOINT PROTECTOR

The present invention relates to contact sport joint protectors and, more particularly, to joint protectors for protecting the knee or elbow limb joints of athletes.

There are a variety of joint protectors, such as knee and elbow pads, in the prior art for use in protecting the knee or elbow joints of athletes. However, such joint protectors have proved to be deficient in a number of respects. For example, in the case of knee pads used by football players, they are unduly bulky, they tend to slip from the knee and also to abrade the knee and the areas surrounding the knee. Another major deficiency of such knee pads has been their inability to conform to the contour of the knee and those areas of the leg above and below the knee, both when the knee is straight and when it is bent, causing the knee protector to slip and so leave the knee vulnerable to injury.

The same deficiencies exist in prior art elbow pads.

It is, therefore, a major object of the present invention to provide a novel contact sport joint protector for protecting an athlete's knee or elbow limb joints as well as one which conforms to the limb contours without abrading the limb, has less tendency to slip and which is of light weight.

This is accomplished, according to the present invention, by providing a unitary, relatively thick, foam-filled, semi-rigid, resilient, molded plastic pad, preferably of generally uniform thickness and of generally rectangular compound-curved configuration of greater length than width, with the lengthwise curve of substantially greater radius than the widthwise curve to conform to the shape of the limb joint.

The novel pad of the invention has smooth inner and outer membranes with a thick layer of resilient foam therebetween, the inner and outer membranes being connected together around the peripheral edge of the pad to form end edges and relatively thick side edges to provide a generally concave smooth inner surface adapted to contact the limb joint and a generally convex smooth outer surface.

According to the present invention, the inner surface and the opposed side edges of the pad have at least one and preferably a plurality of generally parallel, longitudinally spaced, opposed hinge grooves extending inwardly from each of the opposed side edges, generally perpendicular thereto. The hinge grooves are longitudinally spaced from one another and from the end edges to define a hinge portion adapted to overlie the limb joint to enable being of the normally straight pad at the hinge portion upon bending of the limb joint and resilient return of the pad to its normally straight configuration upon straightening of the limb joint. The grooves are preferably of decreasing width and depth from the side edges toward their inner ends, with their opposed inner ends spaced from one another, so that the central portion of the inner surface of the pad is smooth. A backing layer of soft, foam plastic material may be adhered to the inner surface of the plastic pad.

Other objects, features, and advantages of the present invention will appear from the following detailed description of a preferred embodiment thereof, taken together with the accompanying drawings, wherein:

FIGS. 1 and 2 are, respectively, front and rear plan views of the joint protector of the invention;

FIGS. 3 and 4 are, respectively, transverse sectional views taken along lines 3—3 and 4—4, respectively, of FIG. 1;

FIG. 5 is a longitudinal sectional view of the joint protector of FIGS. 1 and 2, taken along lines 5—5 of FIG. 1, showing it in use as a knee pad secured in the clothing of an athlete and in contact with the knee joint, with the leg in straight position; and FIG. 6 is a view similar to FIG. 5 showing the knee pad bent to conform to a bent knee.

Referring to the drawings, and particularly to FIGS. 1 through 4 thereof, the present invention provides a novel contact sport joint protector, generally designated 20, for protecting a limb joint of an athlete, either the elbow or the knee, shown in FIGS. 5 and 6 in use as a knee pad for protecting a knee 12.

The novel joint protector 20 of the invention comprises a unitary, relatively thick, foam-filled, resilient, molded plastic pad of generally uniform thickness and of generally rectangular compound-curve configuration of greater length than width, with the lengthwise curve being of substantially greater radius than the widthwise curve to conform to the shape of knee 12.

Pad 20 is preferably molded in one piece of any suitable organic plastic foam material, such as a crosslinked polyester or polyethylene foam material, which may be molded to provide a foam interior with smooth exterior membrane surfaces. Typical of such materials is ¾ inch thick, semi-rigid, closed cell, crosslinked polyethylene foam material.

As so molded, resilient pad 20 is semi-rigid and normally straight, as shown in FIGS. 1, 2 and 5, and provides a smooth inner membrane 22 and a smooth outer membrane 24 with a thick layer of resilient foam 26 therebetween. Membranes 22 and 24 are connected together around the peripheral edge of pad 20 to form relatively thick side edges 30, 32 and end edges 34, 36 providing a generally concave, smooth surfaced, inner membrane 22 and a generally convex, smooth surfaced, outer membrane 24.

In accordance with the present invention, inner membrane 22 and each of opposed side edges 30, 32 are provided with three generally parallel, longitudinally spaced, opposed hinge grooves 38, 40, 42 and 44, 46, 48, respectively, extending inwardly from each of opposed side edges 30 and 32, generally perpendicular thereto and longitudinally spaced from one another and from end edges 34 and 36, defining a hinge portion 62 which overlies knee 12 to enable bending of the normally straight pad 20 at hinge portion 62 upon bending of knee 12 and resilient return of pad 20 to its normally straight configuration upon straightening of knee 12, as best shown in FIGS. 5 and 6.

Hinge grooves 38, 40, 42 and 44, 46, 48 are preferably of a depth of about one-half the thickness of pad 20 at side edges 30, 32 and are of decreasing width and depth from side edges 30, 32 toward their inner ends, with their opposed inner ends 50, 52, 54, 56, 58 and 60 transversely spaced from one another, so that central portion 28 of inner membrane 22 is smooth. A backing layer 64 of soft, foam plastic material, such as ¼ inch thick urethane foam sheet material, may be adhered to the inner surface of the plastic pad.

In use, as best shown in FIGS. 5 and 6, knee pad 20 is placed in front of knee 12 and secured in pant leg 14 by inserting its end edges 34, 36 into leg pockets 16, 18, with its hinge portion 62 overlying knee 12 and its smooth central portion 28 covered by backing layer 64 in contact with knee 12. With knee 12 is straight, as illustrated in FIG. 5, the normally straight pad 20 and backing layer 64 and the contours of knee 12 and the areas surrounding it to protect it. When knee 12 is bent, as illustrated in FIG. 6, hinge grooves 38, 40, 42 and 44, 46, 48 are compressed to enable pad 20 to bend and and maintain its protection of knee 12.

What is claimed is:

1. A contact sport joint protector for protecting a limb joint, comprising a unitary, foam-filled, semi-rigid, resilient, molded plastic pad of generally uniform thickness and normally straight configuration said pad having smooth inner and outer membranes with a thick layer of resilient foam therebetween connected together around the peripheral edge of said pad to form relatively thick side edges providing a generally concave inner surface and a generally convex smooth outer surface said inner surface and said opposed side edges having a plurality of generally parallel, longitudinally spaced, opposed, hinge grooves extending inwardly from said opposed side edges generally perpendicular thereto with their opposed inner ends spaced from one another said grooves defining a hinge portion adapted to overlie said limb joint to enable bending of said pad at said hinge portion upon bending of said limb joint.

2. A contact sport joint protector for protecting a limb joint, comprising a unitary, relatively thick, foam-filled, semi-rigid, resilient, molded plastic pad of generally uniform thickness and of generally rectangular compound-curved configuration of greater length than width with the lengthwise curve of substantially greater radius than the widthwise curve to conform to the shape of said limb joint said pad having smooth inner and outer membranes with a thick layer of resilient foam therebetween connected together around the peripheral edge of said pad to form end edges and relatively thick side edges providing a generally concave inner surface and a generally convex smooth outer surface said inner surface and said opposed side edges having at least one hinge groove extending inwardly from each of said opposed side edges generally perpendicular thereto with their opposed inner ends spaced from one another and longitudinally spaced from one another and from said end edges said grooves defining a hinge portion adapted to overlie said limb joint to enable bending of said normally straight pad at said hinge portion upon bending of said limb joint and resilient return of said pad to its normally straight configuration upon straightening of said limb joint.

3. The joint protector as claimed in claim 1 or 2, wherein said grooves are of decreasing width and depth from said side edges toward their inner ends.

4. A contact sport joint protector for protecting a limb joint, comprising a unitary, relatively thick, foam-filled, semi-rigid, resilient, molded plastic pad of generally uniform thickness and of generally rectangular compund-curved configuration of greater length than width with the lengthwise curve of substantially greater radius than the widthwise curve to conform to the shape of said limb joint said pad having smooth inner and outer membranes with a thick layer of resilient foam therebetween connected together around the peripheral edge of said pad to form end edges and relatively thick side edges providing a generally concave inner surface and a generally convex smooth outer surface said inner surface and said opposed side edges having at least one hinge groove extending inwardly from each of said opposed side edges generally perpendicular thereto and longitudinally spaced from one another and from said end edges said grooves being of decreasing width and depth from said side edges toward their opposed inner ends and having said opposed inner ends spaced from one another, wherein said grooves define a hinge portion adapted to overlie said limb joint to enable bending of said normally straight pad at said hinge portion upon bending of said limb joint and resilient return of said pad to its normally straight configuration upon straightening of said limb joint.

5. The joint protector as claimed in claim 1, 2, or 4, further including a backing layer of soft, foam plastic material adhered to the inner surface of said plastic pad.

* * * * *